US006471309B1

(12) United States Patent
Turner

(10) Patent No.: US 6,471,309 B1
(45) Date of Patent: Oct. 29, 2002

(54) STORAGE UNIT

(75) Inventor: Murray John Turner, Mulgrave (AU)

(73) Assignee: Rapini Pty Ltd., Victoria (AU)

( * ) Notice: Subject to any disclaimer, the term of this patent is extended or adjusted under 35 U.S.C. 154(b) by 50 days.

(21) Appl. No.: 09/666,626

(22) Filed: Sep. 20, 2000

(30) Foreign Application Priority Data

Sep. 20, 1999 (AU) ..... PQ2973

(51) Int. Cl.[7] ..... A47B 53/00; A47F 5/00

(52) U.S. Cl. ..... 312/201; 312/198; 52/243.1; 211/162

(58) Field of Search ..... 312/198, 199, 312/200, 201, 132, 334.24, 334.25; 52/243.1; 211/162

(56) References Cited

U.S. PATENT DOCUMENTS

| | | | | | |
|---|---|---|---|---|---|
| 670,227 | A | * | 3/1901 | Gray | 312/334.25 X |
| 3,801,176 | A | | 4/1974 | Higbee | 312/199 |
| 3,957,322 | A | | 5/1976 | Mastronardi et al. | 312/198 |
| 4,432,589 | A | | 2/1984 | Sattel | 312/198 |
| 4,615,449 | A | * | 10/1986 | Naito et al. | 312/201 X |
| 4,657,317 | A | * | 4/1987 | Gemma | 312/198 |
| 4,833,840 | A | * | 5/1989 | Kalischewski et al. | 52/243.1 X |
| 4,991,725 | A | * | 2/1991 | Welsch et al. | 312/201 X |
| 5,577,348 | A | * | 11/1996 | Keller | 52/243.1 X |
| 5,680,942 | A | * | 10/1997 | McAllister et al. | 211/162 |

FOREIGN PATENT DOCUMENTS

| | | | | |
|---|---|---|---|---|
| AU | 575731 | | 3/1987 | |
| CH | 358208 | * | 12/1961 | 312/334.25 |
| GB | 352053 | * | 6/1931 | 312/334.25 |

* cited by examiner

*Primary Examiner*—James O. Hansen
(74) *Attorney, Agent, or Firm*—Sheridan Ross P.C.

(57) ABSTRACT

A storage unit having at least one movable storage module is provided. According to the invention, the storage unit includes at least one support device having at least one support rail. A carrying device interconnected to the storage module engages the support device, thereby carrying at least a first portion of the weight of the storage module. A rolling device interconnected to the storage module engages the floor to carry a second portion of the weight of the storage module. The provided storage unit allows heavy loads to be carried by the movable storage module along a path defined by the support device.

25 Claims, 1 Drawing Sheet

STORAGE UNIT

FIELD OF THE INVENTION

The invention relates to a storage unit. More particularly the invention relates to a storage unit which efficiently utilizes available floor space by providing at least one storage module readily movable so as to facilitate access to storage means.

BACKGROUND OF THE INVENTION

Whilst the following discussion concerns a storage unit applicable for use in hospitals and nursing homes, it is to be understood that the same principles apply to any storage system which utilizes at least one movable storage module. Such systems can be found in warehouses, on factory floors and in wholesale stores.

Storage systems which utilize movable storage modules are well known. Typically these systems employ a track system to support and guide one or more storage modules for movement in a desired direction in order to open up a selected aisle space for access to a desired part of the storage system. Each storage module can in turn contain several shelves.

Typically prior art storage systems incorporate movable storage modules mounted on a pair of spaced parallel guide rails located on a base platform such as a floor. The guide rails are typically U shaped in cross-section and hence comprise an open continuous channel. The movable modules are typically mounted on wheels which locate within the channel provided by the guide rails. An operator can push the whole storage module along a path defined by the guide rails. In this arrangement the guide rails act to both support and guide the movable modules.

This known system has several noticeable disadvantages. Floor mounted rails can interfere with the movement of wheeled carts across the rails to and from storage modules. This in turn may require manual exertion on the part of the operator to lift or roll the wheeled cart over floor mounted guides, which may lead to the cart spilling its contents. The contents may break or if previously sterile, become contaminated. This type of system is impractical in hospitals or research laboratories which often use and store delicate and sterilised equipment. Similarly it cannot be used to store foods which can become unhygienic if dropped on to a floor. This system also presents a potential safety hazard to operators who may inadvertently trip on floor mounted guide rails.

In another example of a known prior art shelving system, a guide mechanism is provided which is suspended above the floor. In this arrangement the guide mechanism includes a guide rail in the form of an inverted U shaped channel opening substantially towards a floor or base platform. A guide roller attached to an elongated shaft which extends upwardly from the top of a movable unit. The guide roller is located within the inverted U shaped channel and acts to guide the movable unit along a desired path as defined by the channel. The movable unit is supported by a plurality of wheels which facilitate movement across the floor or base platform when a unit is pushed to provide access to the shelving. The wheels may be of an anti-swivel type.

Although this configuration can overcome some of the inherent problems associated with floor mounted guide rails there are other inherent problems with this system. The movable modules are still essentially floor driven in sense that the movement is facilitated by the wheels. The full load is supported by the wheels and this increases the manual exertion required for the operator to move the movable module.

Yet, another example of a known storage system involves the mounting of storage modules on air cushions. The storage modules can be guided by rollers having a vertical axis and confined in an upwardly open U shaped channel secured to the floor or base platform. However, this is a complex design expensive to manufacture and time consuming to install.

Similarly storage modules can be powered for movement by an electric motor, again this is a complex design which is expensive to manufacture and time consuming to install.

The foregoing does not constitute an admission as to the state of common general knowledge in the art in Australia as it existed as at the priority date of a claim of this application.

SUMMARY OF THE INVENTION

According to the invention a storage unit is provided comprising:

- at least one support device having at least one support rail mounted above a floor or base member;
- at least one storage device comprising at least one movable storage module; and
- at least one carrying device for carrying at least a portion of the weight of a storage module; wherein
- the carrying device is co-operable with the support rail so as to carry at least a portion of the weight of a movable storage module and facilitate movement of the storage module across the floor or base member along a path defined by the support device.

The floor or base member is preferably substantially planar and substantially level. The floor may be the floor of the building, room or space within which the storage unit according to the present invention is installed. Optionally a false floor or base is provided upon which the present invention is installed. A base is preferred where the floor is unsuitable for the installation of a unit according to the present invention.

Although it is convenient to further describe the invention relative to a floor it is to be appreciated that the floor referred to hereafter optionally may be in the form of a false floor or base.

The storage device according to the present invention may include one or more stationary storage modules and at least one movable storage module.

The storage modules may be suitable for storing a variety of items. Most preferably the storage modules each have a plurality of shelves. For use in hospitals and other applications where air circulation is required, the shelves are preferably in the form of racks having an open or wire configuration which facilitates air flow. The shelving may be fixed or movable shelving depending upon the intended application. However, the provision of storage units which have closed shelving, storage bins, cupboards, drawers and other known storage elements are also envisaged within the scope of the present invention.

A movable module according to the present invention may optionally include one or more casters. The casters may engage the floor and thereby carry a portion of the weight of the module. In this arrangement the weight of the module is jointly carried by the carrying device and the casters.

Preferably at least one rolling device comprising at least one castor is fixed to the bottom of each movable storage module. Although a movable storage module according to the present invention can be suspended relative to the floor from the support device, the rolling device can be provided in order to redistribute the amount of weight to be supported by the support device.

It is to be appreciated that even when fitted, casters may be located clear of the floor in which case the weight of the movable module is carried by the carrying device in cooperation with the support rail. This may be a preferred arrangement in some applications such as hospitals where mounting of castors clear of the floor may facilitate cleaning and the provision of a sterile environment.

In one preferred arrangement the height of the castors provided is adjustable between a position in which the castors engage the floor and carry a portion of the weight of a movable module, and a position in which the castors are clear of the floor and carry no weight unless the support rail sags or the distance between the rail and the floor is otherwise reduced.

At least one carrying device may be mounted on each movable storage module according to the invention. The carrying device carrys at least a portion of the weight of the movable storage module when co-operably mounted on the support device.

Preferably, the carrying device includes a roller device comprising at least one roller mounted for rotary movement about an axis general parallel to the floor. The roller may be mounted on the support rail to form the co-operable engagement of the carrying device and the support device.

Preferably, the support rail is mounted so as to extend substantially parallel to the floor. The support rail preferably has at least one lip or ridge extending generally parallel relative to the floor. The roller device is preferably locatable on the lip or ridge.

Preferably the support rail is a substantially C-shaped section mounted, so that the opening faces the floor. The support rail may have a roof, two walls projecting from the roof, and a pair of complimentary ridges extending generally inwardly from each wall so as to define a generally rectangular continuous channel incorporating a defined space between the complimentary ridges. The support rail is preferably mounted in accordance with the present invention with the defined space facing the floor. Preferably the carrying device is locatable within the substantially rectangular support rail. The rollers are preferably supported on the complementary lips or ridges of the support rail.

When the support rail is in the form of a substantially C-shaped section, the carrying device may be locatable within the section. In this arrangement the carrying device preferably includes at least one pair of rollers. A separate roller of a pair of rollers may engage a separate one of the lips which define the opening in the C-shaped section.

Preferably the roller device further comprises antifriction element. The antifriction element may engage the support rail to facilitate movement relative thereto. The antifriction element may be made of material having an antifriction surface.

In one preferred embodiment a shaft is mounted on the storage module unit. The shaft may extend generally perpendicularly relative to the floor. The carrying device may be mounted on the shaft and preferably extends laterally therefrom.

In a further preferred embodiment, the support device includes two generally parallel support rails. In this preferred embodiment the two support rails may each be mounted above the floor. In this arrangement, the carrying device includes at least two rollers a separate one of which engages each rail. In this way the weight of the module mobile storage borne by the carrying device is distributed between the two rails.

In another preferred embodiment, a support rail according to the present invention has a generally inverted V-shaped outer surface for shedding foreign matter. This embodiment is particularly useful in hospitals and nursing homes.

In a further preferred embodiment a support rail according to the present invention is mounted on two stationary storage modules placed on the floor and spans the distance there between.

DESCRIPTION OF THE DRAWINGS

The invention will now be further explained and illustrated by reference to the accompanying drawings in which.

Figure 1:
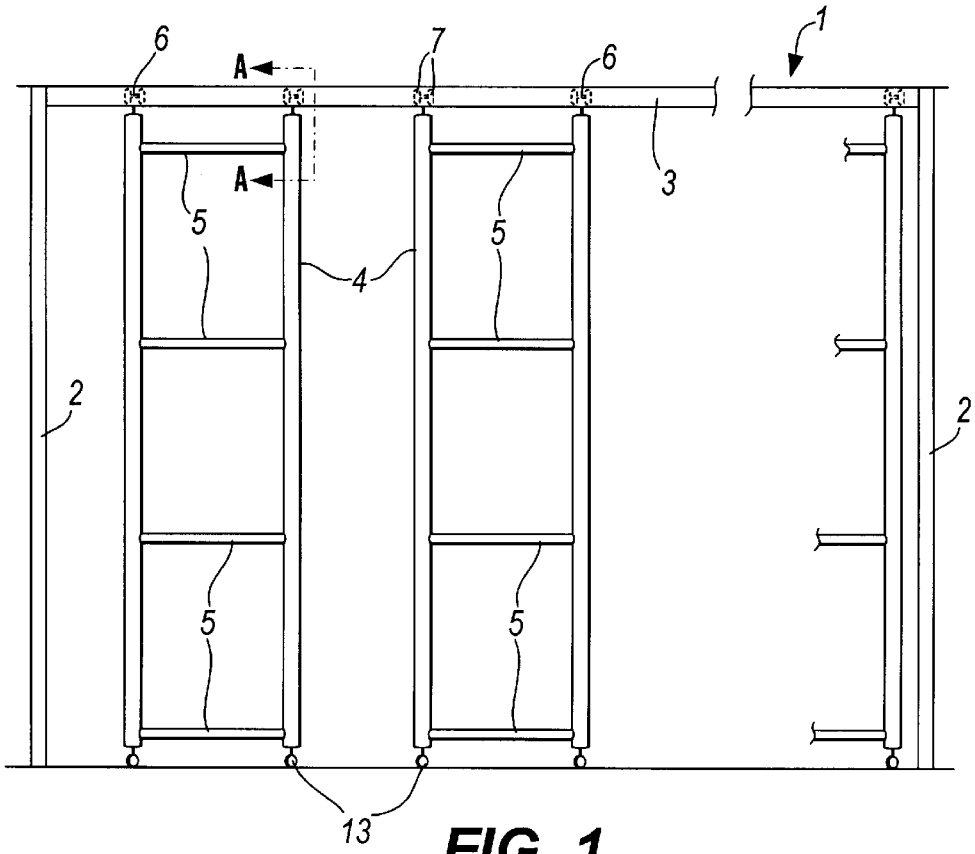
FIG. 1 is a side view taken partly in vertical cross section of the storage unit constructed and assembled in accordance with one preferred embodiment of the present invention.

In the preferred embodiment, illustrated the storage unit 1 includes two spaced stationary support structures 2 on which support device in the form of support rail 3 is mounted. At least one movable storage module generally indicated at 4 is carried between the support structures 2. Movable storage module 4 includes a plurality of shelves 5. Items (not shown) can be placed on shelves 5 so as to maximize the storage capacity of movable storage module 4. As can be seen in FIG. 1 carrying device in the form of trolley 6 is mounted on each corner of each movable storage module 4. Each trolley 6 comprises two pairs of complimentary rollers 7 each pair of rollers being journalled for rotation on an axle in the form of cross beam 8. The cross beam 8 is in turn mounted on a T shaped strut 9. The strut 9 has a threaded bottom (not shown), which can locate in a complementary recess (not shown) in storage module 4. Storage module 4 can be secured firmly to the carrying device by the manipulation bolt 8. Optionally trolley 6 may be rigidly or rotatable mounted on storage module 4.

Figure 2:
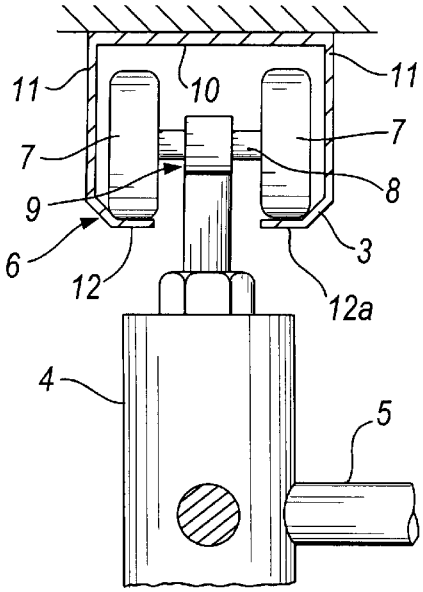
FIG. 2 is a vertical cross-sectional view taken on the plane A—A in FIG. 1.
Figure 3:
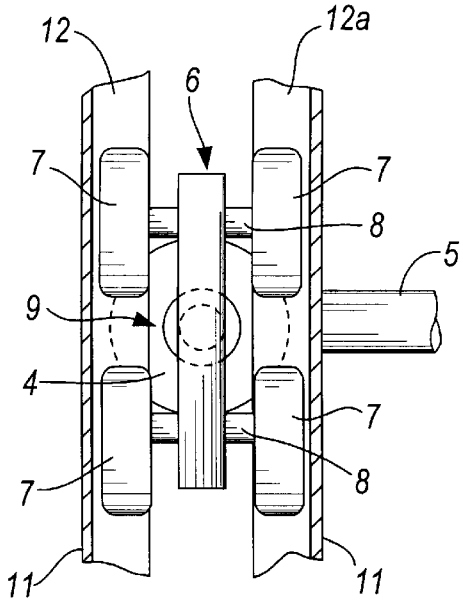
FIG. 3 is a top cross sectional view taken on the plane A—A in FIG. 1.

As clearly shown in FIG. 2, the support rail 3 is substantially rectangular. The rail has a roof 10, a pair of complimentary walls 11 and support lips 12 and 12*a* extending inwardly from each wall 11. Disposed between the lips 12 and 12*a* is a longitudinal slot. In operation the carrying device 7 is located within the rail 3, the rollers 8 engage the lips 12 and 12*a* and allow the simple translocation of the movable storage module 4 along a path defined by the slot of support rail 3. The support rail 3 thus takes the weight of at least a portion of each movable storage module 4 via the rollers 7 of trolley 6 bearing downwardly on lips 12, 12*a*.

In the preferred embodiment illustrated movable storage modules are fitted with castors 13. It is possible however to suspend movable storage modules 4 from the support rail 3. or to adjust the height of support rail 3 to partially redistribute the weight of movable storage module 4 variably between support rail 3 and the castors 13.

In an alternative arrangement (not shown), stationary support structures 2 are replace by one or more stationary storage modules. Each stationary, storage module may be generally of a similar shape and configuration to movable modules 4. However, a stationary module would generally not include casters 13. Casters 13 may be replaced by feet (not shown) of similar height to casters 13 or the outer vertical staunchions of the frame of the storage module may extend to the floor. In this arrangement, carrying device 6 may be replaced by mounting device (not shown) for mounting support rail 3 on the stationary storage module. When stationary storage modules are used at either end of a support rail, the need for separate stationary support structures 2 of the type shown in the drawings is avoided.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

What is claimed is:

1. A storage unit comprising:

(a) at least one support device having at least one support rail mounted above a floor or base member, the support rail comprising:

(i) a roof, (ii) a pair of walls projecting from the roof, and (iii) a pair of support lips extending generally inwardly from each wall, wherein the dimensions of the support rail define a generally rectangular continuous channel incorporating a defined space between the support lips;

(b) at least one storage device comprising at least one movable storage module; and (c) at least one carrying device for carrying at least a first portion of the weight of the at least one movable storage module;

(d) a rolling device, the rolling device engaging the floor thereby carrying a second portion of the weight of the at least one movable storage module;

wherein the carrying device is co-operable with the support rail so as to carry at least a portion of the weight of the at least one movable storage module and facilitating movement of the at least one movable storage module across the floor along a path defined by the support device.

2. The storage unit of claim 1, wherein the storage device is selected from the group comprising shelving, storage bins, cupboards and drawers.

3. The storage unit of claim 1 wherein the storage device further comprises one or more stationary storage modules.

4. The storage unit of claim 1 wherein the at least one movable storage module comprises a plurality of shelves.

5. The storage unit of claim 4 wherein the shelves are movable.

6. The storage unit of claim 1 wherein the height of the rolling device is adjustable between a position in which the rolling device engages the floor and carry a portion of the weight of a movable module, and a position in which the rolling device is clear of the floor and carries no weight unless the support rail sags or the distance between the rail and the floor is otherwise reduced.

7. The storage unit of claim 1 wherein the rolling device comprises at least one castor fixed to the bottom of the at least one movable storage module.

8. The storage unit of claim 1 wherein the carrying device may be mounted on at least one movable storage module.

9. The storage unit of claim 1 wherein the carrying device carries at least a portion of the weight of the at least one movable storage module when co-operably mounted on the support device.

10. The storage unit of claim 1 wherein the carrying device comprises at least one roller mounted for rotary movement about an axis generally parallel to the floor.

11. The storage unit of claim 10 wherein the at least one roller is mounted within the support rail.

12. The storage unit of claim 10 wherein the roller device includes at least one antifriction element, the antifriction element engaging the support rail to facilitate movement relative thereto.

13. The storage unit of claim 12 wherein the antifriction element is made of material having an antifriction surface.

14. The storage unit of claim 1 wherein the support rail is mounted so as to extend substantially parallel to the floor.

15. The storage unit of claim 1 wherein the support rail comprises at least one lip or ridge extending generally parallel relative to the floor, the support rail specifically adapted to accommodate the location of the roller device.

16. The storage unit of claim 1 wherein the carrying device comprises rollers that are supported on the complementary lips or ridges of the support rail.

17. The storage unit of claim 1 wherein the support rail is mounted with the defined space facing the floor, the support rail specifically adapted to accommodate the location of the carrying device.

18. The storage unit of claim 1 wherein the at least one support rail is a substantially C-shaped section, the defined space facing the floor.

19. The storage unit of claim 18 wherein, the at least one carrying device is locatable within the C shaped section and comprises at least one pair of rollers, a separate roller of each pair of rollers engaging a separate one of the lips defining the opening in the C-shaped section.

20. The storage unit of claim 1 wherein the at least one support rail is mounted on two stationary storage modules placed on the floor and spans the distance therebetween.

21. The storage unit according to claim 1 wherein the support device comprises two generally parallel support rails.

22. The storage unit of claim 21 wherein the two support rails are mounted above the floor.

23. The storage unit according of claim 21 wherein the carrying device comprises at least two rollers a separate one of which engages each rail, the weight of the movable storage module borne by the carrying device being distributed between the two rails.

24. The storage unit of claim 21, wherein said at least one movable storage module has four corners, and wherein a carrying device is interconnected to said at least one movable storage device at each of said corners.

25. The storage unit of claim 1 wherein the floor or base member is substantially planar and substantially level.

* * * * *